US005461866A

United States Patent [19]

Sullivan et al.

[11] Patent Number: 5,461,866

[45] Date of Patent: Oct. 31, 1995

[54] GAS TURBINE ENGINE COMBUSTION LINER FLOAT WALL COOLING ARRANGEMENT

[75] Inventors: Dennis J. Sullivan, Vernon; Aaron S. Butler, Ledyard; Mark A. Kelley, Hartford, all of Conn.

[73] Assignee: United Technologies Corporation, Hartford, Conn.

[21] Appl. No.: 356,089

[22] Filed: Dec. 15, 1994

[51] Int. Cl.[6] ..... F23R 3/42

[52] U.S. Cl. ..... 60/757

[58] Field of Search ..... 60/752, 757, 755, 60/756, 760, 39.32

[56] References Cited

U.S. PATENT DOCUMENTS

| | | | |
|---|---|---|---|
| 4,104,874 | 8/1978 | Caruel et al. | 60/757 |
| 4,109,459 | 8/1978 | Ekstedt et al. | 60/757 |
| 4,302,941 | 5/1984 | Du Bell | 60/757 |
| 4,446,693 | 5/1984 | Pidcock et al. | 60/757 |
| 4,567,730 | 2/1986 | Scott | 60/755 |
| 4,614,082 | 9/1986 | Sterman et al. | 60/752 |
| 4,790,140 | 12/1988 | Sato et al. | 60/757 |
| 5,083,422 | 1/1992 | Vogt | 60/752 |
| 5,388,412 | 2/1995 | Schulte-Werning et al. | 60/760 |

*Primary Examiner*—Timothy S. Thorpe
*Attorney, Agent, or Firm*—Edward L. Kochey, Jr.

[57] ABSTRACT

When second shell section 18 diverges with respect to first shell section 16, the second liner panel 50 is located with a changing spacing from the shell. The liner is close to the shell at the upstream edge 68, and farther from the liner at the downstream end 57. The downstream end of the first liner panel 64 overlaps the second liner panel 50 on the gas side.

4 Claims, 2 Drawing Sheets

GAS TURBINE ENGINE COMBUSTION LINER FLOAT WALL COOLING ARRANGEMENT

TECHNICAL FIELD

The invention relates to floating liners secured to combustor shells and in particular to a liner effectively cooperating with an adjacent liner for improved cooling.

BACKGROUND OF THE INVENTION

Because of the extremely high temperatures existing in a gas turbine engine combustor the shell of the combustor must be protected. This is accomplished with liners supported on the wall of the combustor.

A float wall liner is shown in U.S. Pat. No. 4,302,941 issued to Thomas L. DuBell. The panels are supported in a floating manner which permits relative expansion without incurring high stress. Cooling air passes through openings in the shell and is impinged against the cold side of the liner panels. The flow then passes both upstream and downstream behind the panel with respect to the gas flow in the combustor. A smooth flow exits from the downstream side of each panel passing smoothly over the gas side surface of the downstream panel. The upstream passing flow cools the upstream portion of the panel, turns and mixes with the flow exiting from the upstream panel. This achieves effective cooling of the liner panels with the minimum flow.

Minimum turbulence is desired to minimize the mixing of the hot gas with the surface cooling flow, which would increase the temperature of the gas gripping the panel surface.

When the shell sections diverge with respect to one another the conventional cooling panel protrudes into the gas flow a considerable amount, thereby increasing the turbulence. The discharge flow from this panel is also substantially angled away from the downstream panel decreasing the effectiveness of the cooling. A bent panel bridging the angle change of the shell would accomplish the cooling, but would provide too much stiffness to accommodate the thermal differential expansion.

SUMMARY OF THE INVENTION

The combustor is formed of an arcuate shell defining the combustion zone which could be an annular combustor. This shell has axially arranged contiguous sections including a first shell section and a downstream adjacent second section. At one location a second shell section diverges with respect to the first shell section and the direction of the gas flow.

A first floating liner panel is supported from and spaced from the first shell section, this liner being segmented around the circumference of the shell. A first cooling flow space is thereby established between the first liner panel and the first shell which is fluid communication with the gas flow at both the upstream and downstream ends of the liner. The cooling flow passes through this space with a portion traveling downstream and a second portion going upstream and discharging.

A second floating liner panel is supported from and spaced from the second shell section and also segmented around the circumference. There is a second cooling flow space between the second liner panel and the second shell also in fluid communication with the gas flow at both the upstream and downstream ends. The downstream end of the first liner panel overlaps the upstream end of the second liner panel on the gas side. The downstream flow discharging from under the first liner passes over the gas side of the second liner.

The second cooling flow space is smaller at the upstream end than the downstream end in that the liner surface is closer to the shell at this end than at the second end. This decreases the extension of the first panel into the gas stream when the same overlap distance is used and further decreases the differential angles so that the flow more smoothly passes across the second floating liner.

DESCRIPTION OF THE PREFERRED EMBODIMENT

Figure 1:
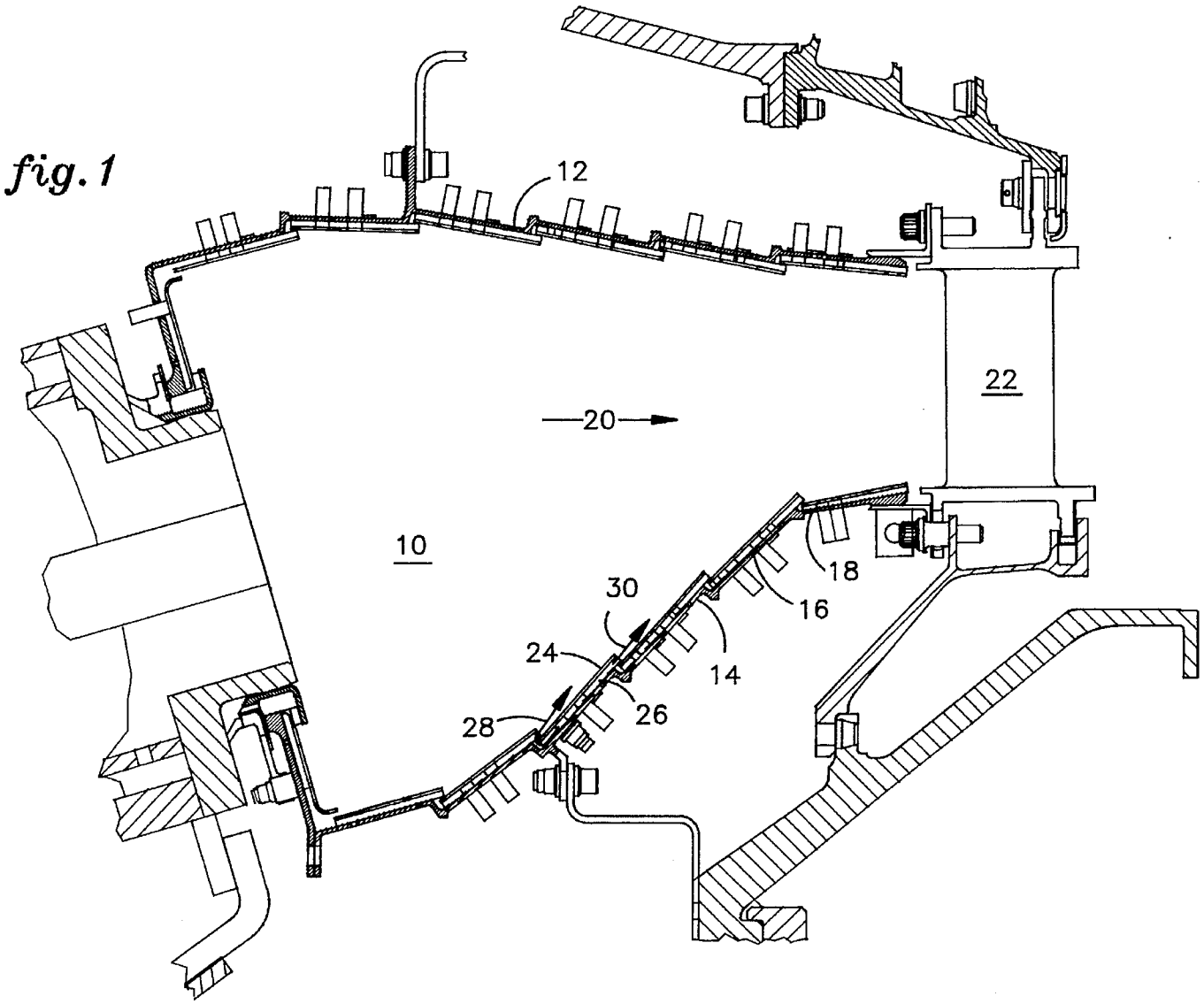
FIG. 1 is a view of an annular combustor.

Referring to FIG. 1 an annular combustor 10 is defined by an inner annular shell 12 and an outer annular shell 14. Each shell is formed of a plurality of axially arranged contiguous sections such as first shell section 16 and a second shell section 18.

Gas flow 20 passes through the combustor entering first stage vanes 22 and first stage blades (not shown).

Conventional floating wall liner panels 24 are located throughout the majority of the combustor with cooling air passing through the shell opening 26 impinging against the cold side of the liner 24. A portion of the flow passes as flow 28 upstream with respect to the gas flow where it joins cooling flow passing from an upstream panel, passing across the surface of liner panel 24. Another portion of the flow 30 passes out the upstream end of the panel across the surface of a downstream located panel.

Figure 2:
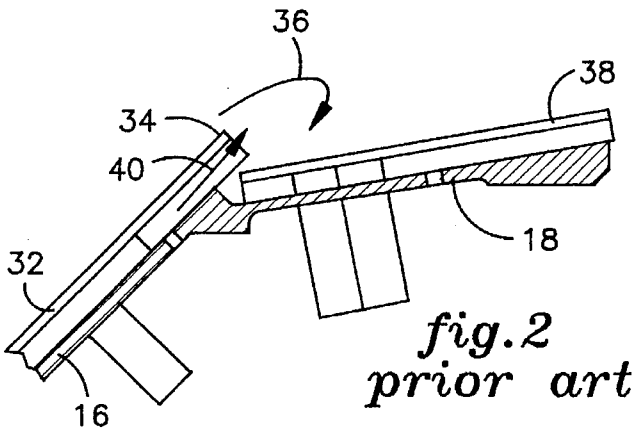
fig. 2 prior art
FIG. 2 is a prior art panel arrangement.

Shell section 18 diverges from shell section 16 with respect to gas flow 20. FIG. 2 shows how prior art liner panel 32 extends into the gas flow at end 34 creating turbulence 36 which would mix the gas flow from the combustor with the surface flow across downstream panel 38. Also cooling flow 40 issuing from under panel 32 is directed substantially into the gas flow rather than across the surface of panel 38 is desired.

Figure 3:
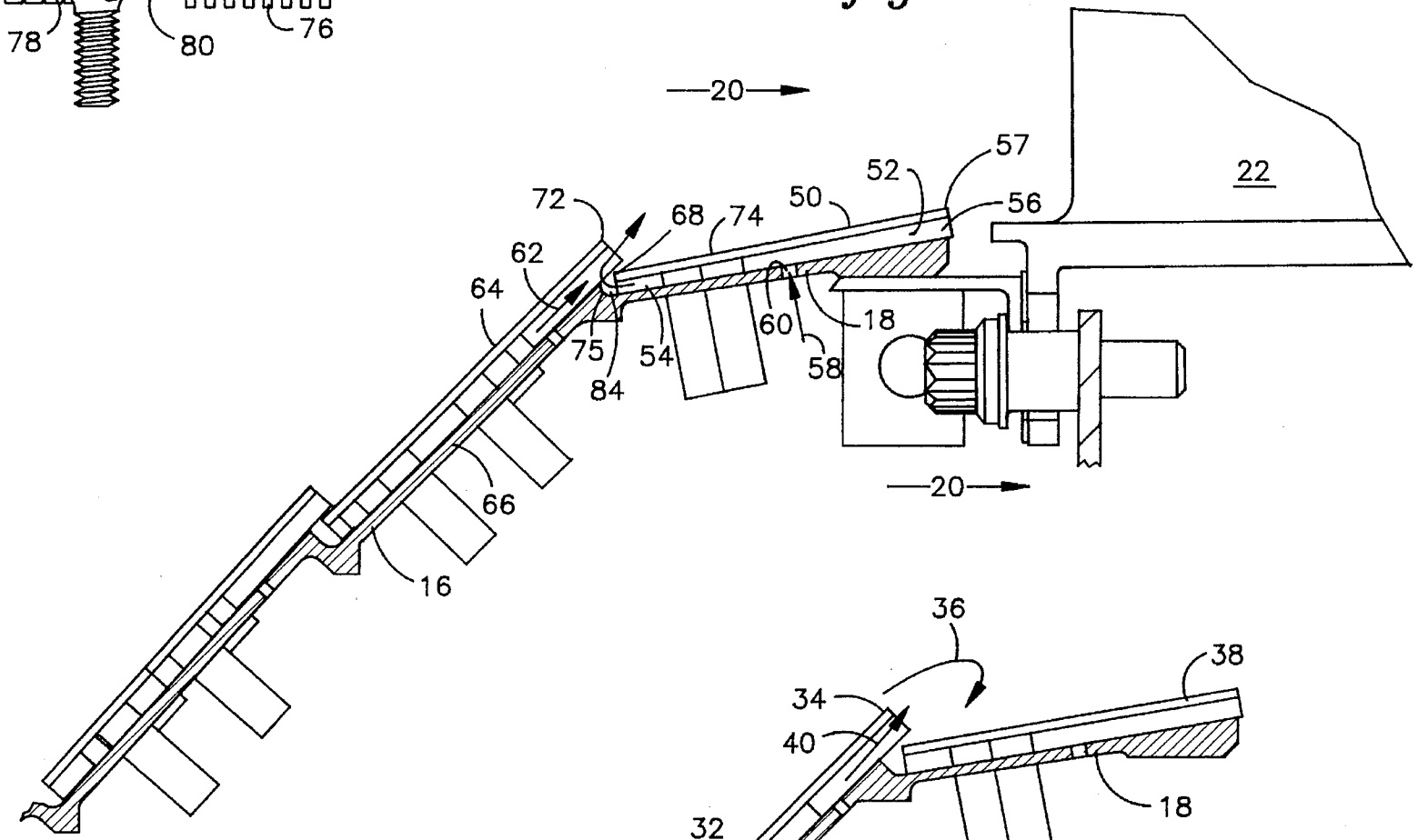
FIG. 3 is a panel arrangement with a tapered pin height arrangement.

The second floating liner panel 50 shown in FIG. 3 has a second cooling flow space 52 between the shell 18 and the liner 50. The height of the flow opening 54, measured perpendicular to the liner, is less at the upstream end, with respect to gas flow 20 than the space 56 between the shell and the panel.

Cooling air flow 58 passes through opening 60 in the shell impinging against panel 50 where space 52 is in fluid communication with the gas flow 20 at both the upstream and downstream ends. A minor portion of the flow passes upstream past the area 54 or adjoins with flow 62 passing under first floating liner panel 64 which is supported from first shell section 66. The flow passes over extended cooling surface in the form of pins. These pins are shown in FIG. 3, and are arranged in an equilateral triangle array.

The edge 68 of panel 50 is brought closer to shell section 70 because of the smaller space 54. Accordingly the tip 72 of the first liner 64 is brought in closer to the shell. The angle between the two contiguous panels is also decreased so that not only is there less turbulence but the flow tends to stay closer to the surface 74 of panel 50. This also decreases the depth of joggle 75.

Figure 4:
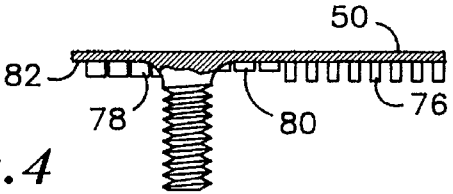
FIG. 4 is a detail of the panel.

FIG. 4 is a detail of the panel 50 with tall pins 76 which are located at end 56 and short pins 78 located at end 54. These pins vary from a maximum height of 0.09 inches to a minimum of 0.06 inches. In the center of the panel there are some additional short pins 80 which are used in the conventional manner in the area of inlet flow 18 to permit that flow to spread along the panel. Thus the pins at the upstream end are two thirds the length of the pins at the downstream end.

It can be seen that pin 76 is located substantially at the end of panel 50 while the small pins 78 has a space 82 at the end of the panel, this space being approximately equal to the diameter of the pin. This space facilitates the turning of the flow at location 84 (FIG. 3) where the flow 86 turns to join flow 62, while the pins 76 at the downstream end improve cooling in this hot area.

Enhanced flexibility in packaging the liner panel walls is provided, since by graduating the pin height in the axial direction, the forward edge of a panel can be located closer to the shell wall, improving the fit up with the preceding panel. The reduced height could also be set to meter the counterflowing cooling flow.

We claim:

1. A liner arrangement for a gas turbine engine combustor having a gas flow therethrough comprising:

an arcuate shell defining a combustion zone;

said shell having axially arranged contiguous sections including a first shell section and a down stream adjacent second shell section;

said second shell section diverging with respect to said first shell section in the direction of gas flow;

a first floating liner supported from and spaced from said first shell section, and segmented around the circumference;

a first cooling flow space between said first liner and said first shell in fluid communication with said gas flow at both the upstream and downstream ends with respect to said gas flow;

a second floating liner supported from and spaced from said second shell section, and segmented around the circumference;

a second cooling flow space between said second liner and said second shell in fluid communication with said gas flow at both the upstream and downstream end with respect to said gas flow;

the downstream end of said first liner overlapping the upstream end of said second liner on the gas side thereof, and said second cooling flow space having a smaller dimension perpendicular to said liner at the upstream end than the downstream end with respect to gas flow.

2. A liner arrangement as in claim 1, further comprising:

said second floating liner having a plurality of integral pins extending toward said second shell; and said pins near the upstream end being shorter than said pins near the downstream end.

3. A liner arrangement as in claim 2, wherein:

said pins at the upstream end are two thirds the length of the pins at the downstream end.

4. A liner arrangement as in claim 2, wherein:

said pins have a space between said pins and the upstream end of said panel; and said pins do not have any space between said pins and the downstream end of said panel.

* * * * *